US005975808A

United States Patent [19]

Fujita

[11] Patent Number: 5,975,808

[45] Date of Patent: Nov. 2, 1999

[54] PILE OR PILE ASSEMBLY FOR ENGINEERING AND CONSTRUCTION WORKS

[76] Inventor: Yasuhiro Fujita, 31-7 Namiyanagi, Motomiya, Morioka-shi, Iwate 020, Japan

[21] Appl. No.: 08/893,747

[22] Filed: Jul. 11, 1997

[51] Int. Cl.[6] ..... E02D 5/80

[52] U.S. Cl. ..... 405/244; 405/251; 405/253; 52/155; 52/156; 52/159; 52/165

[58] Field of Search ..... 405/231, 232, 405/244, 251, 253; 52/155, 156, 159, 165

[56] References Cited

U.S. PATENT DOCUMENTS

| | | | |
|---|---|---|---|
| 3,763,655 | 10/1973 | Galuska | 405/244 |
| 3,974,604 | 8/1976 | Conn et al. | 405/244 X |
| 3,986,366 | 10/1976 | Dinsmore, Jr. | 52/155 X |
| 4,813,816 | 3/1989 | Simanjuntak | 405/232 X |
| 4,889,451 | 12/1989 | Simanjuntak | 405/244 |

*Primary Examiner*—David Bagnell
*Assistant Examiner*—Tara L. Mayo
*Attorney, Agent, or Firm*—Leighton K. Chong

[57] ABSTRACT

A pile assembly which is driven into the earth for building foundations of engineering and construction employs a leading pile comprising a hollow column having a plurality of openings formed in a side wall thereof and a lower sharpened tip end and an open upper end, a wedge component having a plurality of elongated wedge members. The wedge component is movable downwardly in a space within the column. The leading pile has a guide component for guiding said elongated wedge members through the openings of the column into the earth when the wedge means is depressed. At least one coupling pile is connected to the leading pile comprising a hollow column having a plurality of openings formed in a side wall thereof and an open lower end and an open upper end, a wedge component having a plurality of elongated wedge members and an inner pillar for depressing the wedge component of the lower pile, which is movable downwardly in a space within the column, and a guide component for guiding the elongated wedge members through openings of the column into the earth when the wedge component is depressed.

33 Claims, 8 Drawing Sheets

PILE OR PILE ASSEMBLY FOR ENGINEERING AND CONSTRUCTION WORKS

BACKGROUND OF THE INVENTION a) Field of the Invention

The present invention relates to a pile or a pile assembly used for engineering and construction works such as shore protection, road construction, foundation work for architecture and engineering. In particular, the present invention relates to a pile or pile assembly for engineering work, having therein a core member with wedge members, which can be also used as a pile for indicating a boarder.

b) Description of Related Art

There have been various piles for engineering works including a pile which is circular in cross section and has a cone shaped tip end, a pile which is triangular in cross section, a pile which is triangular in the whole shape and has a pointed tip end, a pile which is triangular in shape and has an another member such as a disc mounted at its lower end and a pile having only a lateral bar mounted on the lower portion thereof.

Prior art engineering work piles having various shapes and sizes have been used. Most of these piles are made of steel, concrete or steel reinforced concrete. Most popular engineering work piles are formed into cylindrical-cone shapes or columns. When these engineering piles are used for protection of river, sea shore or roads, the piles are obliquely or vertically driven into the earth. This is also applied for the working for architecture.

However, even if the piles for engineering work are driven into soft ground, there are drawbacks that they sway and are unstable or removed. In case of hard ground, there are drawbacks that the piles may sway or be lifted after the lapse of time. The prior art piles for construction work have a poor resistance to earthquake. If such piles are used, work itself is dangerous and the working cite is also dangerous even after completion of work.

SUMMARY OF THE INVENTION

It is therefore an object of the present invention to provide a pile or pile assembly used for engineering work, which overcomes the above-mentioned drawbacks in the prior art and can keep more stable condition in the earth.

It is another object of the present invention to provide a pile or pile assembly used for engineering work in which a wedge assembly consists of a core member and wedge members mounted thereon can be easily inserted into the pile.

In order to accomplish the above-mentioned object, the present invention provides a leading pile comprising a hollow column having openings formed in the side wall thereof and a lower sharpened tip end and an open upper end; wedge means having a plurality of elongated wedge members, the wedge means being movable downwardly in a space within said column; and guide means for guiding the elongated wedge members through the openings of the column into the earth when the wedge means is depressed.

The wedge means may comprise a core member having a size smaller than the size of space in the hollow column to which the plurality of wedge members are mounted, said wedge members are extended downwardly from the core member.

The present invention further provides a coupling pile comprising a hollow column having openings formed in the side wall thereof and an open lower end and an open upper end; wedge means having a plurality of elongated wedge members and an inner pillar for depressing wedge means of the lower pile, the wedge means being movable downwardly in a space within said column; and guide means for guiding the elongated wedge member through the openings of the column into the earth when the wedge means is depressed.

The wedge means may comprise a core member having a size smaller than the size of space in the hollow column to which the plurality of wedge members and the pillar are mounted, the wedge members and pillar are extended downwardly from the core member.

The core member may be formed with equally spaced notches.

The wedge members may be equally spaced along coaxial peripheries.

The wedge members disposed at inner position may have a longer length than those of the outer wedge members.

The wedge members may be formed at least one side edge thereof with serration.

The openings may be provided in the side wall in such a manner that they correspond to the respective wedge members.

The guide means may comprise a bottom which is downwards inclined in an outer radial direction, side portions integrally connected to both ends of the inclined bottom and a flange which is integral with the bottom and side portions and is mounted on the outer surface of the side wall of the column to surround each of the openings.

The present invention further provides a pile assembly comprising a leading pile including a hollow column having openings formed in a side wall thereof and a lower sharpened tip end and an open upper end; wedge means having a plurality of elongated wedge members, the wedge means being movable downwardly in a space within the column; and guide means for guiding the elongated wedge members through the openings of the column into the earth when the wedge means is depressed, and, at least one coupling pile to be connected to the lower pile including a hollow column having openings formed in a side wall thereof and an open upper end and an open lower end; wedge means having a plurality of elongated wedge members and an inner pillar for depressing wedge means of the lower pile, the wedge means being movable downwardly in a space within said column; and guide means for guiding the elongated wedge members through the openings of the column into the earth when the wedge means is depressed.

BRIEF DESCRIPTION OF THE DRAWINGS

The present invention will be described by way of embodiments with reference to drawings.

DESCRIPTION OF THE PREFERRED EMBODIMENTS

Figure 1:
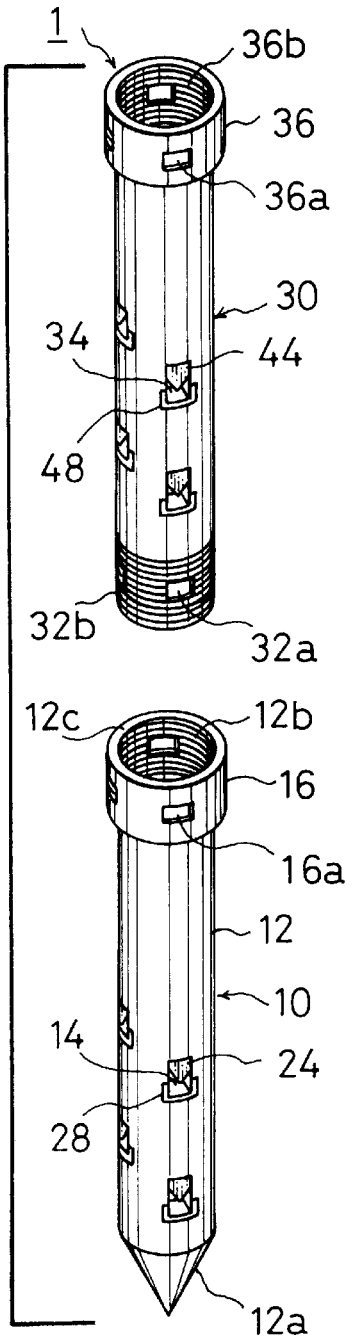
FIG. 1 is an exploded perspective view showing a pile assembly for engineering work of the present invention.
Figure 2:
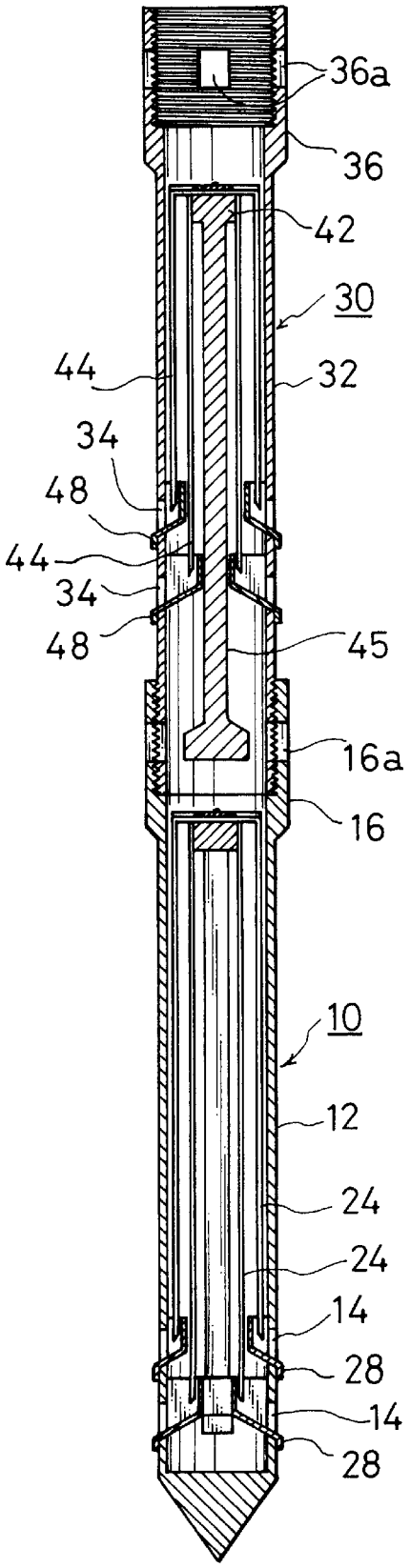
FIG. 2 is an vertical sectional view showing the pile assembly of FIG. 1.

Referring now to FIG. 1, there is showing a pile assembly 1 which usually comprises a leading pile 10 and a coupling pile 30. The leading pile 10 is coupled to the coupling pile 30 by a known method such as thread connection, welding and fitting. The pile assembly 1 used for building foundations of engineering working does not necessarily comprise one leading pile 10 and one coupling pile 30. The coupling pile 30 may be successively coupled to other piles 30 depending upon the kind of work. The leading pile 10 and coupling pile(s) 30 may be formed into various shapes such as cylindrical column or polygonal section columns including trigonal section, pentagonal section columns. The piles 10, 30 are usually made of metal, concrete or steel reinforced concrete. However, it is possible to form them of a hard synthetic resin according to the kind of work.

Figure 3:
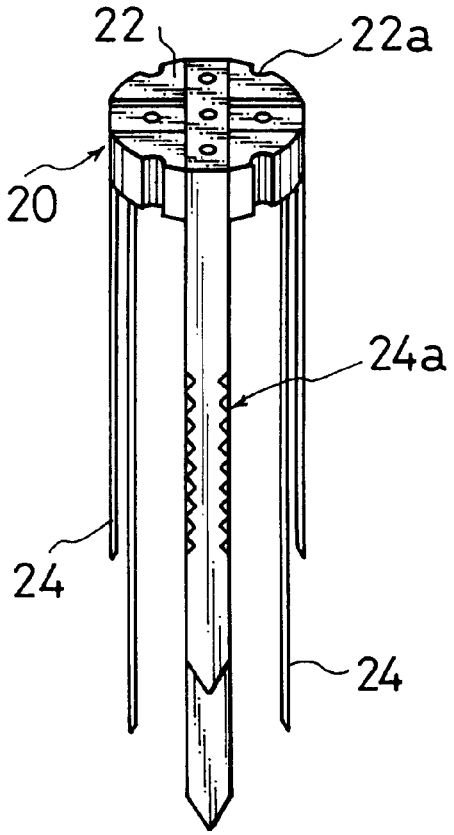
FIG. 3 is a perspective view showing a wedge core assembly which is inserted in a leading pile.

The leading pile 10 comprises a hollow cylindrical column 12 having one end (lower tip end) 12*a* which is conical or pyramid and the other upper end 12*b* which is opened. The leading pile 10 further includes an annular connection collar 16 at the upper end to which the coupling pile 30 is connected. The leading pile 10 is substantially sealed at the tip end and is opened or hollow at the other upper end. The leading pile 10 is formed in its side wall with a plurality of (eight in the embodiment) openings 14 in appropriate positions. In this embodiment, the four upper openings 14 are vertically offset from the lower four openings and are symmetric in relation to the central axis of the pile 10. The connection collar 16 may be formed on the inner surface thereof with female threads 12*c* and the lower position of the coupling pile 30 be formed on its outer surface with male threads 32*b* for easy connection therebetween. The leading pile 10 further includes a wedge core assembly 20 which is shown in FIG. 3 in detail.

The wedge core assembly 20 of the leading pile 10 comprises a core member 22 which is in the form of circular disc and a plurality of elongated wedge members 24 which extend from the core member 22. The wedge members 24 are fastened to the core members 22 by suitable means such as welding or screwing. The wedge members 24 consist of outer wedge members which are angularly equally spaced around the central axis of the wedge core assembly 20 and inner wedge members which are radially inwardly disposed with respect to the outer wedge members and angularly equally spaced around the central axis thereof as shown in FIG. 3. In the preferred embodiment as shown in FIG. 3, the inner wedge members are longer than the outer wedge members.

It is to be noted that the angular positions of the wedge members 24 correspond to the openings 14 in the side wall of the column 12 of the leading pile 10. In the preferred embodiment, the numbers of the wedge members 24 and the openings 14 are both eight. Of course, this number may be changed to any desired number such as six, or ten. Further, the number of wedge members 24 may be smaller than that of the openings 14.

Figure 14A:
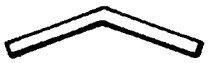
FIG. 14A–14C are cross sectional views showing the cross sections of the wedge members.
Figure 14B:
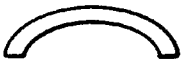
Figure 14C:
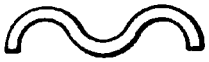

The wedge members 24 may be formed of a material such as steel which may be flex when the wedge core assembly 20 is driven downwards as will be described hereafter. The wedge members 24 have sharp distal ends so that they can easily penetrate into the earth and may be formed on at least one side edge with serration 24*a* to increase the anchorage strength. The wedge members may be a sword like configuration (FIG. 14A), a bow like configuration (FIG. 14B) or a wave like configuration (FIG. 14C) in cross section to prevent them from being bent easily.

The core member 22 may be formed with notches 22*a* for easy downward movement of the wedge core assembly 20 in the hollow column 12.

Figure 8:
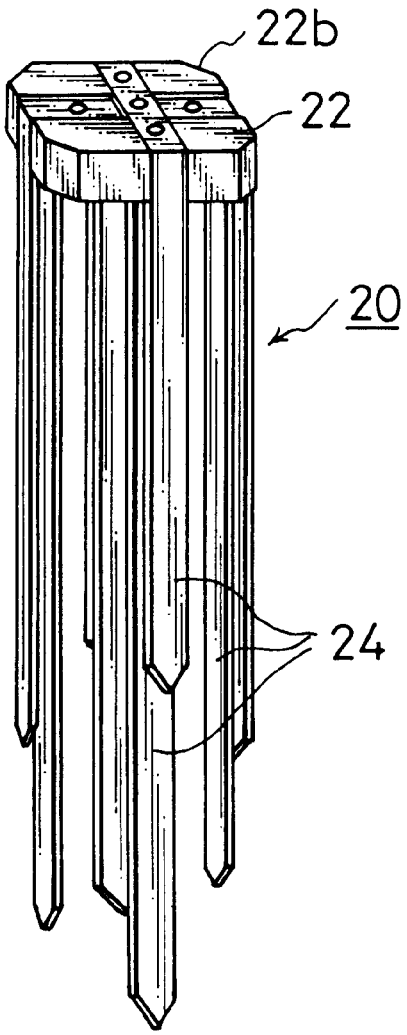
FIG. 8 is a perspective view showing a modified wedge core assembly used for the leading pile.

The circular core member 22 may be modified into another shape such as square as shown in FIG. 8. In this case, the notches 22*a* in FIG. 3 may be replaced with beveled faces 22*b*.

Figure 6:
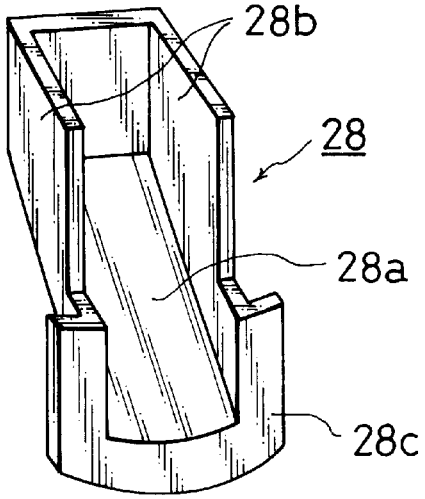
FIG. 6 is a perspective view showing a wedge guide pocket fitting.

The leading pile 10 further includes wedge guide pocket fitting 28 for guiding the tip ends of the descending wedge members 24 so that they can pass through corresponding openings 14. Each of the wedge guide pocket fittings 28 includes an inclined bottom 28*a*, a pair of side portions 28*b* integrally connected to both sides of the inclined bottom 28*a* and a flange 28*c* serving as a bracket, which is integrally formed with each other as shown in FIG. 6 in detail. The wedge guide pocket fittings 28 are mounted on the other side of the side wall of the leading pile 10 so that the flange 28*c* of each wedge guide pocket fitting 28 surrounds each opening 14. The sizes of the wedge guide pocket fittings 28 may be different depending upon the mounting positions. The wedge guide pocket fittings 28 disposed at upper positions have such small sizes that they will not hinder the descending movement of the inner wedge members 24.

Figure 7:
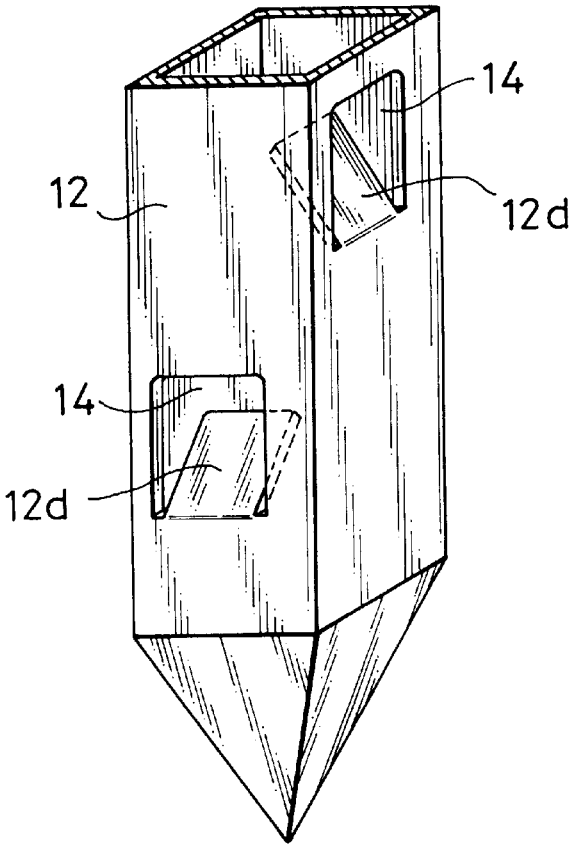
FIG. 7 is a perspective view showing a modified wedge guide means for guiding the tip ends of wedge members.

Wedge guide means may also be provided by cutting the side wall of the column 12 to form tongue flaps 12*d* and bending them inwardly as shown in FIG. 7. The tip ends of the wedge members 24 slide on the inclined surfaces of the tongue flaps 12*d* and pass through the openings 14 of the column 12 to penetrate into the earth.

Figure 4:
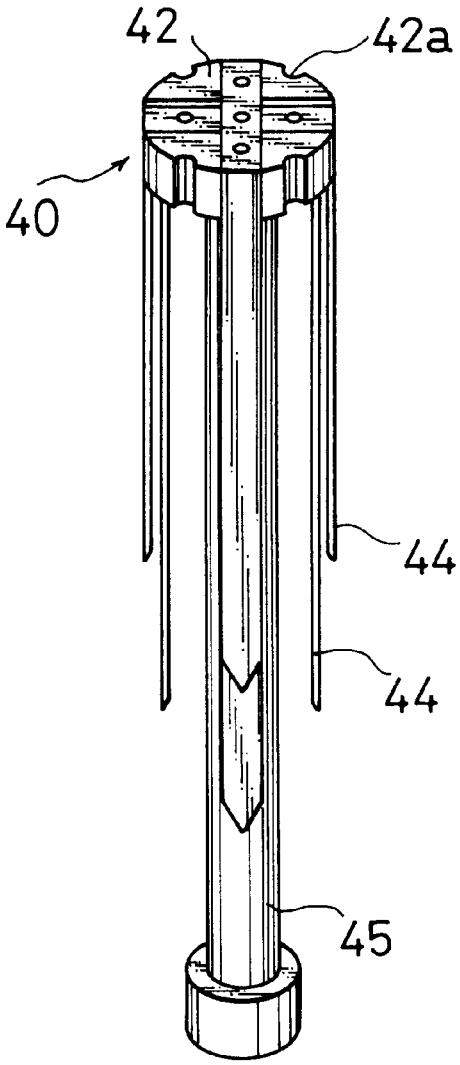
FIG. 4 is a perspective view showing a wedge core assembly which is inserted in a coupling pile.

The coupling pile 30 comprises a hollow cylindrical column 32 having one end (lower end) which is opened and the other end (upper end) which is opened too. The coupling pile 30 further includes an annular connection collar 36 at the upper end to which a further coupling pile 30 is to be connected. The hollow column 32 is formed in its side wall with a plurality of (eight in the embodiment) openings 34 in appropriate positions. In his embodiment, the openings are symmetric in relation to the central axis of the pile 30. The connection collar 36 may be formed on the inner surface thereof with female threads 36*b* for easy connection with another coupling pile 30. The coupling pile 30 further includes a wedge core assembly 40 which is shown in FIG. 4 in detail.

Figure 9:
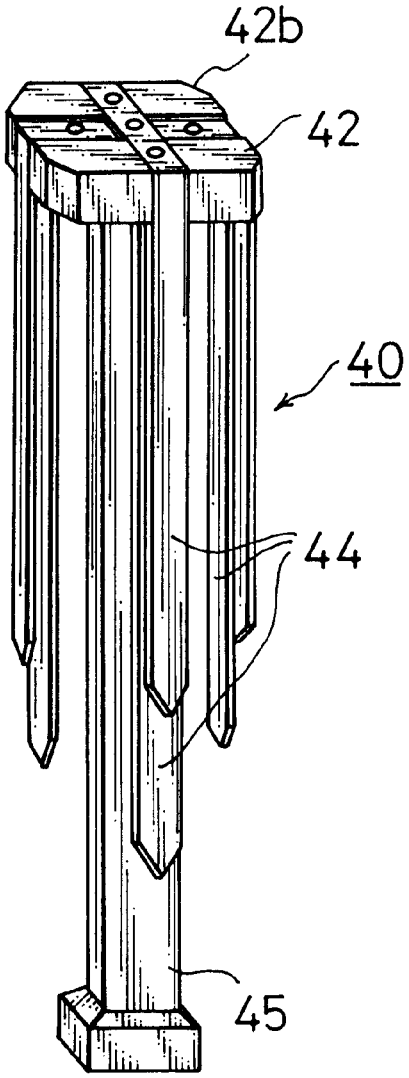
FIG. 9 is a perspective view showing a modified wedge core assembly used for the coupling pile.

The wedge core assembly 40 of the coupling pile 30 comprises a core member 42 which is in the form of circular disc and a plurality of elongated wedge members 44 and an inner pillar 45 which extend from the core member 42. The wedge members 44 and the pillar 45 are fastened to the core members 42 by suitable means such as welding or screwing. The wedge members 44 includes outer wedge members, which are angularly equally spaced around the central axis of the wedge core assembly 40, and inner wedge members 44, which are radically inwardly disposed with respect to the outer wedge members 44 and angularly equally spaced around the central axis thereof as shown in FIG. 9. The inner wedge members 44 are longer than the outer wedge members 44. The pillar 45 extends beyond the lower ends of the wedge members 44 to the vicinity of the lower end of the column 32.

It is to be noted that the angular positions of the wedge members 44 correspond to the openings 34 in the side wall of the column 32 of the coupling pile 30.

The wedge members 44 may be formed of a material such as steel which may be flex when the wedge core assembly 40 is driven downwards as will be described hereafter. The wedge members 44 have sharp distal ends so that they can easily penetrate into the earth and may be formed on at least one side edge with serration 44*a* to increase the anchorage strength.

The core member 42 may be formed with notches 42*a* for easy downward movement of the wedge core assembly 40 in the hollow column 32.

Figure 11:
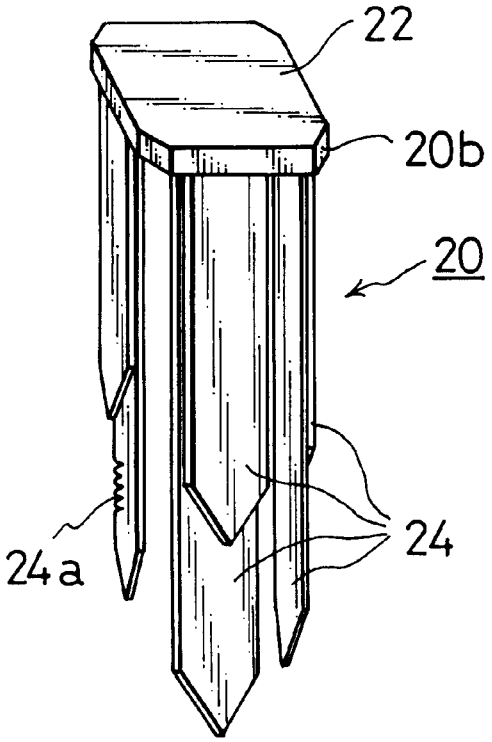
FIG. 11 is a perspective view of a further modified wedge core assembly used for the leading pile.

The circular core member 22 may be modified into another shape such as square as shown in FIGS. 8 and 11. In this case, the notches 22*a* in FIG. 3 may be replaced with beveled faces 22*b* shown in FIGS. 8 and 11.

The coupling pile 30 further includes wedge guide pocket fitting 48 for guiding the tip ends of the descending wedge member 44 so that they pass through corresponding openings 34.

Description of the wedge guide pocket fitting 48 of the coupling pile 30 is omitted since it is identical with the fitting 28 of the leading pile 10.

Figure 10:
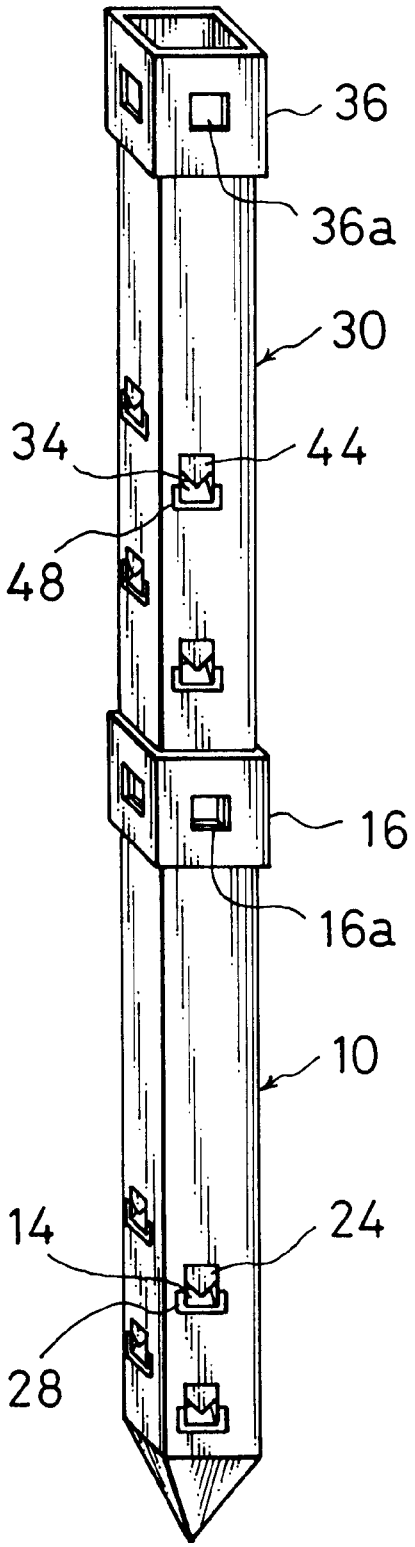
FIG. 10 is a perspective view showing a modified pile assembly according to the present invention.

Although the columns of the piles 10 and 30 are circular in cross section in the above-mentioned embodiment, they may be square in cross section as shown in FIG. 10. It is preferable that the openings 14, 34 through which the wedge members 24, 44 pass are formed in the opposite faces so that they are symmetrical with each other for balancing the penetration forces applied to the wedge members 24, 44.

Figure 12:
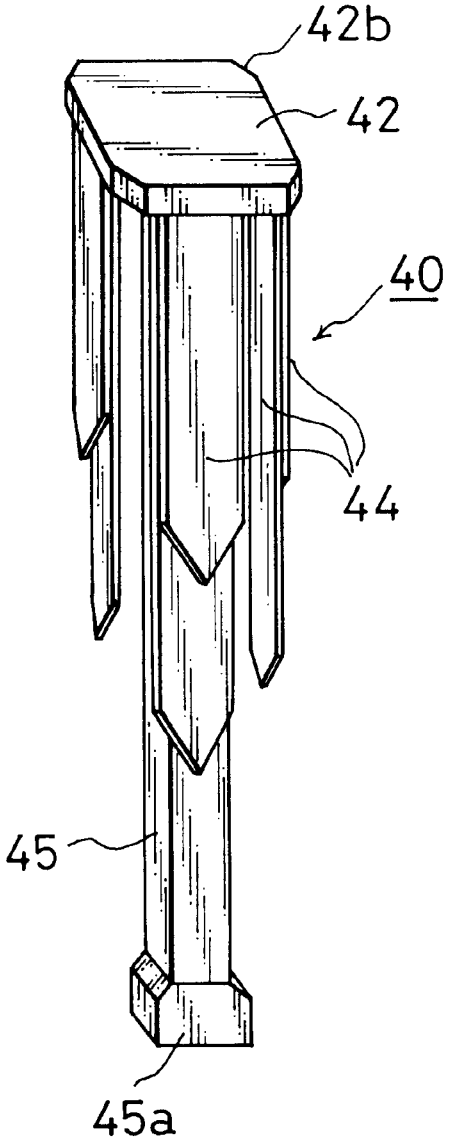
FIG. 12 is a perspective view of a further modified wedge core assembly used for the coupling pile.
Figure 13:
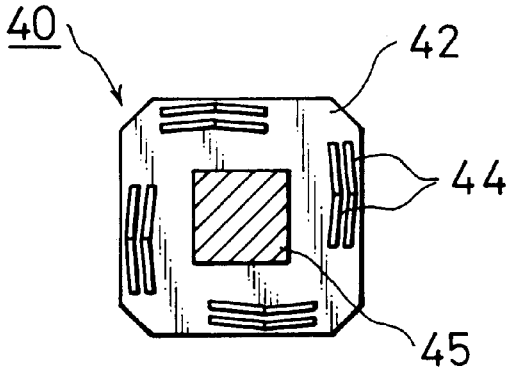
FIG. 13 is a sectional view showing the wedge core assembly shown in FIG. 11 or 12.

In this modified embodiment, it is preferable that the openings 14, 34 are offset to the right (or left) side from the central axis on each side wall as shown in FIG. 10. Correspondingly to this arrangement of the openings 14, 34 the wedge members 24, 44 which are secured to the core member 22, 42 are also offset to the right (or left) side on each side thereof as shown in FIG. 11 and 12.

Now, use of the pile assembly of the present invention will be described.

Only one leading pile 10 may be used in a simple work site. In this case, the leading pile 10 is driven into the earth from the lower end thereof by means of a suitable piling machine (not shown). After an appropriate length of the pile 10 has been inserted into the earth, the wedge core assembly 20 is depressed downwards by a suitable depressing machine (not shown). As the wedge core assembly 20 is forced downwards, the outer wedge members 24 are abut at their tip ends on the corresponding wedge guide pocket fittings 28. The wedge members 24 slide along the inclined bottoms 28*a* of the pocket fittings 28 and pass through the corresponding openings 14 to penetrate into the earth. If necessary, a grout agent or water glass may be grouted by means of pipes or hoses (not shown) inserted through the spaces between the notches 22*a* or beveled faces 22*b* and the inner surface of the pile 10 to increase the anchorage strength of the pile.

In most cases for shore protection or earthquake resistant, only the leading pile 10 is not enough to provide a necessary anchorage strength. One coupling pile 30 is connected to the lower leading pile 10 which has been preliminarily driven into the earth so that the lower open end of the coupling pile 30 is abut to the connection collar 16 of the leading pile 10. The coupling pile 30 is coupled to the leading pile 10 in such a manner the through-holes 32*a* of the former are aligned with those 16*a* of the latter. By doing so, the leading pile 10 can be secured to the coupling pile 30 in line easily.

Another coupling piles 30 may be successively coupled to the lower coupling pile 30 in order to provide a longer pile assembly if necessary.

Figure 5:
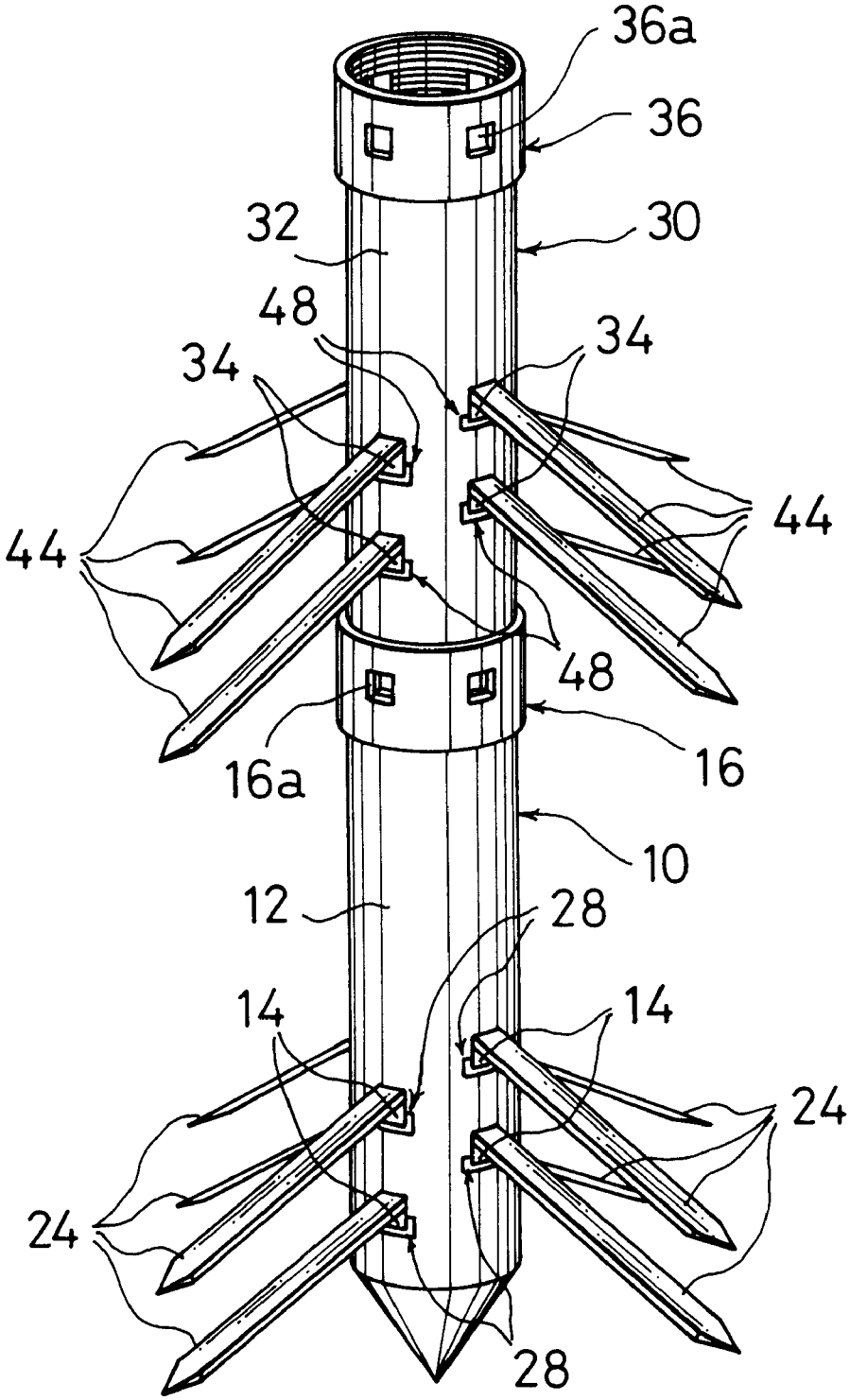
FIG. 5 is a perspective view showing the pile assembly according to the present invention in which the wedge members of the wedge core assembly have been extended and inserted into the earth.

After completion of the coupling of an appropriate number of piles 10 and 30 and driving of them into a necessary depth, the upper most wedge core assembly 40 is depressed by means of an appropriate machine. This causes other lower wedge core assembly 20 (and 40) to be also depressed and the wedge members 24 (44) to penetrate into the earth through the openings 14 (34) as shown in FIG. 5. If necessary, grouting can be conducted through spaces within the column of the piles 10 (30).

What is claimed is:

1. A leading pile comprising:

a hollow column having a plurality of openings formed in a side wall thereof and a lower sharpened tip end and an open upper end;

a wedge component having a plurality of elongated wedge members, said wedge component being movable downwardly in a space within said column; and guide means for guiding said elongated wedge members through said openings of said column into the earth when the wedge component is depressed, wherein some of said plurality of wedge members are disposed in inner positions of said column and have a longer length than other wedge members disposed at outer positions of said column.

2. A leading pile as defined in claim 1 in which said wedge components comprises a core member having a size smaller than the size of space in the hollow column to which said plurality of wedge members are mounted, said wedge members are extended downwardly from the core member.

3. A leading pile as defined in claim 2 in which said core member is formed with equally spaced notches.

4. A leading pile as defined in claim 1 which said wedge members are equally spaced peripherally around the column.

5. A leading pile as defined in claim 1 in which said wedge members are formed at least one side edge thereof with serration.

6. A leading pile as defined in claim 1 in which said openings are provided in the side wall in such a manner that they correspond to the respective wedge members.

7. A leading pile as defined in claim 1 and further including connection means at its upper end for connecting this leading pile with another upper pile.

8. A leading pile as defined in claim 7 in which said connection means is an annular connection collar.

9. A leading pile as defined in claim 7 in which said connection means is formed with holes for alignment with another upper pile.

10. A leading pile as defined in claim 7 in which said connection means is formed with female threads for engaging with another upper pile.

11. A leading pile as defined in claim 1 in which said column has a circular cross section.

12. A leading pile as defined in claim 1 in which said column has a polygonal cross section.

13. A leading pile as defined in claim 12 in which said column has a square cross section.

14. A leading pile as defined in claim 12 in which said openings are offset leftwards or rightwards on the sides of the column.

15. A leading pile comprising:

a hollow column having a plurality of openings formed in a side wall thereof and a lower sharpened tip end and an open upper end;

a wedge component having a plurality of elongated wedge members, said wedge component being movable downwardly in a space within said column; and guide means for guiding said elongated wedge members through said openings of said column into the earth when the wedge component is depressed, in which said guide means comprises a plurality of wedge guide pocket fittings each having an inclined bottom which is downwardly inclined in an outer radial direction, side portions integrally connected to opposing sides of said inclined bottom and a flange which is integral with said bottom and side portions and is mounted on an outer surface of the side wall of said column to surround a respective one of said openings.

16. A coupling pile comprising:

a hollow column having a plurality of openings formed in a side wall thereof and an open lower end and an open upper end;

a first wedge component having a plurality of elongated wedge members and an inner pillar for depressing a second wedge component of a lower pile, said first wedge components being movable downwardly in a space within said column; and guide means for guiding said elongated wedge members through said openings of said column into the earth when the first wedge component is depressed, wherein said first wedge component comprises a core member having a size smaller than the size of space in the hollow column to which said plurality of wedge members and said pillar are mounted, and said wedge members and said pillar are extended downwardly from the core member.

17. A coupling pile as defined in claim 16 in which said core member is formed with equally spaced notches.

18. A coupling pile as defined in claim 16 in which said wedge members are equally spaced peripherally around the column.

19. A coupling pile as defined in claim 16 in which said wedge members are formed at least one side edge thereof with serration.

20. A coupling pile as defined in claim 16 in which said openings are provided in the side wall in such a manner that they correspond to the respective wedge members.

21. A coupling pile as defined in claim 16 and further including connection means at its upper end for connecting this coupling pile with another upper coupling pile.

22. A coupling pile as defined in claim 21 in which said connection means is an annular connection collar.

23. A coupling pile as defined in claim 22 in which said annular collar is formed with holes for alignment with those of another upper coupling pile.

24. A coupling pile as defined in claim 22 in which said column is formed at its lower end with holes which are aligned with those formed in an annular collar of a lower pile.

25. A coupling pile as defined in claim 22 in which said connection means is formed with female threads for engaging with another upper pile.

26. A coupling pile as defined in claim 25 in which said column is formed at its lower end with male threads for engaging with a lower pile.

27. A coupling pile as defined in claim 16 in which said column has a circular cross section.

28. A coupling pile as defined in claim 16 in which said column has a polygonal cross section.

29. A coupling pile as defined in claim 28 in which said column has a square cross section.

30. A coupling pile as defined in claim 28 in which said openings are offset leftwards or rightwards on the side walls of the column.

31. A coupling pile comprising:

a hollow column having a plurality of openings formed in a side wall thereof and an open lower end and an open upper end;

a first wedge component having a plurality of elongated wedge members and an inner pillar for depressing a second wedge component of a lower pile, said first wedge components being movable downwardly in a space within said column; and guide means for guiding said elongated wedge members through said openings of said column into the earth when the first wedge component is depressed, in which some of said plurality of wedge members are disposed in inner positions of said column and have a longer length than other wedge members disposed at outer positions of said column.

32. A coupling pile comprising:

a hollow column having a plurality of openings formed in a side wall thereof and an open lower end and an open upper end;

a first wedge component having a plurality of elongated wedge members and an inner pillar for depressing a second wedge component of a lower pile, said first wedge components being movable downwardly in a space within said column; and guide means for guiding said elongated wedge members through said openings of said column into the earth when the first wedge component is depressed, in which said guide means comprises a plurality of wedge guide pocket fittings each having an inclined bottom which is downwardly inclined in an outer radial direction, side portions integrally connected to opposing sides of said inclined bottom and a flange which is integral with said bottom and side portions and is mounted on an outer surface of the side wall of said column to surround a respective one of said openings.

33. A leading pile in combination with at least one coupling pile which is connected to said leading pile, said leading pile comprising a first hollow column having a first plurality of openings formed in a side wall thereof and a lower sharpened tip end and an open upper end;

a first wedge component having a plurality of elongated wedge members, said first wedge component being movable downwardly in a space within said column; and first guide means for guiding said elongated wedge members through said openings of said column into the earth when the first wedge component is depressed, said coupling pile comprising a second hollow column having a plurality of openings formed in a side wall thereof and an open lower end and an open upper end;

a second wedge component having a second plurality of elongated wedge members and an inner pillar for depressing the first wedge component of said leading pile, said second wedge component being movable downwardly in a space within said column; and second guide means for guiding said second plurality of elongated wedge members through said openings of said second column into the earth when the second wedge component is depressed.

* * * * *